US006119777A

United States Patent [19]

Runia

[11] Patent Number: 6,119,777

[45] Date of Patent: Sep. 19, 2000

[54] LOGGING METHOD

[75] Inventor: Douwe Johannes Runia, Schiedamo, Netherlands

[73] Assignee: Shell Oil Company, Houston, Tex.

[21] Appl. No.: 08/898,171

[22] Filed: Jul. 22, 1997

[51] Int. Cl.[7] ..... E21B 47/00

[52] U.S. Cl. ..... 166/254.2; 166/50; 166/65.1; 166/381

[58] Field of Search ..... 166/381, 50, 65.1, 166/250.16, 254.2

[56] References Cited

U.S. PATENT DOCUMENTS

| | | | |
|---|---|---|---|
| 4,484,628 | 11/1984 | Lanmon, II | 166/254.2 |
| 4,597,440 | 7/1986 | Pottier | 166/50 |
| 4,715,446 | 12/1987 | Wittrisch | 166/381 |
| 4,807,717 | 2/1989 | Winters et al. | 166/99 |
| 4,877,089 | 10/1989 | Burns | 166/65.1 |
| 4,945,987 | 8/1990 | Wittrisch | 166/250.17 |
| 5,265,680 | 11/1993 | Withers et al. | 166/65.1 |
| 5,318,125 | 6/1994 | Wittrisch | 166/277 |
| 5,433,276 | 7/1995 | Martain et al. | 166/50 |
| 5,636,686 | 6/1997 | Wittrisch | 166/50 |

*Primary Examiner*—Hoang Dang

[57] ABSTRACT

The invention relates to a method of operating a logging tool in a wellbore, the wellbore formed in an earth formation, which wellbore is to be provided with a wellbore component, the method including the steps of: arranging the logging tool in a selected relationship relative to the component so that the logging tool is guided by the component through the wellbore during lowering of the component into the wellbore; lowering the component with the logging tool in the selected relationship, through the wellbore to the section of the wellbore; operating the logging tool so as to provide logging data of the earth formation surrounding the wellbore; and transferring the logging data to surface.

17 Claims, 1 Drawing Sheet

LOGGING METHOD

FIELD OF THE INVENTION

The present invention relates to a method of operating a logging tool in a wellbore formed in an earth formation, which wellbore is to be provided with a wellbore component, for example a casing.

SUMMARY OF THE INVENTION

In conventional wellbore drilling a plurality of casing sections of st,pwise decreasing diameter are installed in the wellbore to prevent the wellbore from collapsing and to protect drilling equipment. The wellbore is deepened by rotating a drill string which extends to the bottom of the wellbore through previously installed casing sections. Before installing casing in the newly drilled wellbore section, a logging tool is lowered via a wireline into the uncased wellbore section and operated in order to obtain logging data representing characteristics such as porosity or oil/water content of the earth formation surrounding the uncased wellbore section. A drawback of the conventional method is the required additional drilling rig time during lowering and operating the logging tool. A further drawback is that there is a danger that the logging tool gets blocked in the open wellbore section. Moreover, it may not be possible to operate the logging tool over a significant part of the newly drilled wellbore section, as a consequence of which valuable information on the surrounding formation cannot be obtained.

U.S. Pat. No. 4,570,481 suggests a system consisting of a bundle carrier for insertion in a drill string carrying a bundle of logging tools for simultaneous logging anc, drilling of a wellbore. The speed of logging with this system is rather low, and furthermore the diameter of the logging tools to be applied is limited to the inner diameter of the drill string.

Another proposed logging method is suggested in Oil & Gas Journal, Jun. 10, 1996, pp. 65–66. In this method, a logging tool is pumped down a drill string and operated during tripping of the drill string. This method has several drawbacks, for example the diameter of the logging tool is limited to the inner diameter of the drill string, and the presence of a dowrihole motor obstructs further pumping of the tool. Furthermore, drilling of a further wellbore section before the string is tripped is precluded once the tool is positioned in the drill string. Also, positioning of the tool in the drill string at the desired location requires special technical measures to be taken which make the system rather complicated.

Moreover in either case, but particularly with the normal wireline method, it may not be possible to operate the logging tool over a significant part of the newly drilled wellbore section, as a consequence of which valuable information on the surrounding formation cannot be obtained.

Thus, there is a need to provide an improved logging method which is reliable and which results in a significant reduction of drilling rig time.

SUMMARY OF THE INVENTION

In accordance with the invention there is provided a method of operating a logging tool in a wellbore, the wellbore formed in an earth formation, which wellbore is to be provided with a wellbore component, the method including the steps of: arranging the logging tool in a selected relationship relative to the component so that the logging tool is guided by the component through the wellbore during lowering of the component into the wellbore; lowering the component with the logging tool in the selected relationship, through the wellbore to the section of the wellbore; operating the logging tool so as to provide logging data of the earth formation surrounding the wellbore; and transferring the logging data to surface. The component is preferably a casing.

The term "wellbore component" refers to any component which is to be arranged in the wellbore to form a structural part thereof, and to which the logging tool can be arranged in a selected relationship.

By applying the method of the invention it is achieved that drilling rig time is reduced because the logging tool is lowered together with the wellbore component. Furthermore, wellbore components generally have high mechanical strength so that such wellbore components are capable of protecting the logging tool in the wellbore. Also, the risk that the logging tool becomes blocked in the wellbore, or cannot be moved through highly inclined or horizontal wellbore sections, is reduced because the wellbore component guides the logging tool through the wellbore.

A further reduction of drilling rig time is achieved by inducing the logging tool to measure the parameter simultaneously with the step of lowering the wellbore component into the wellbore.

The wellbore component preferably forms a tubular element, such as a casing, and the logging tool is at least partly arranged within the tubular element.

To obtain logging data from a selected side of the wellbore, the logging tool may be attached to the inner surface of the tubular element at a selected side thereof in correspondence with the earth formation at the selected side of the wellbore to be logged.

The wellbore component can be selected from a wellbore casing, a wellbore liner, a slotted wellbore liner, an expandable slotted liner, a pre-perforated liner, a wellb)re screen, a wire-wrapped screen, and a gravel pack screen.

A logging tool in application of the invention preferably includes at least one tool selected from the group of a gamma ray logging device, a density logging device, a neutron logging device, an NMR logging device, a resistivity logging device, a micro resistivity/calliper logging device, a sonic logging device and any other suitable logging device. If a plurality of such logging devices is applied, the logging devices are preferably arranged in a stacked manner.

To improve communication of the tool with the surrounding formation the tubular element can be provided with a window opposite a selected one of the logging devices, which window is optionally filled with a material selected from fibre reinforced plastic, glass fibre reinforced epoxy and fibre reinforced cement.

When the logging device forms a pad type device, such device may extend through the window so as to contact the wellbore wall.

DESCRIPTION OF A PREFERRED EMBODIMENT

Figures 1, 2:
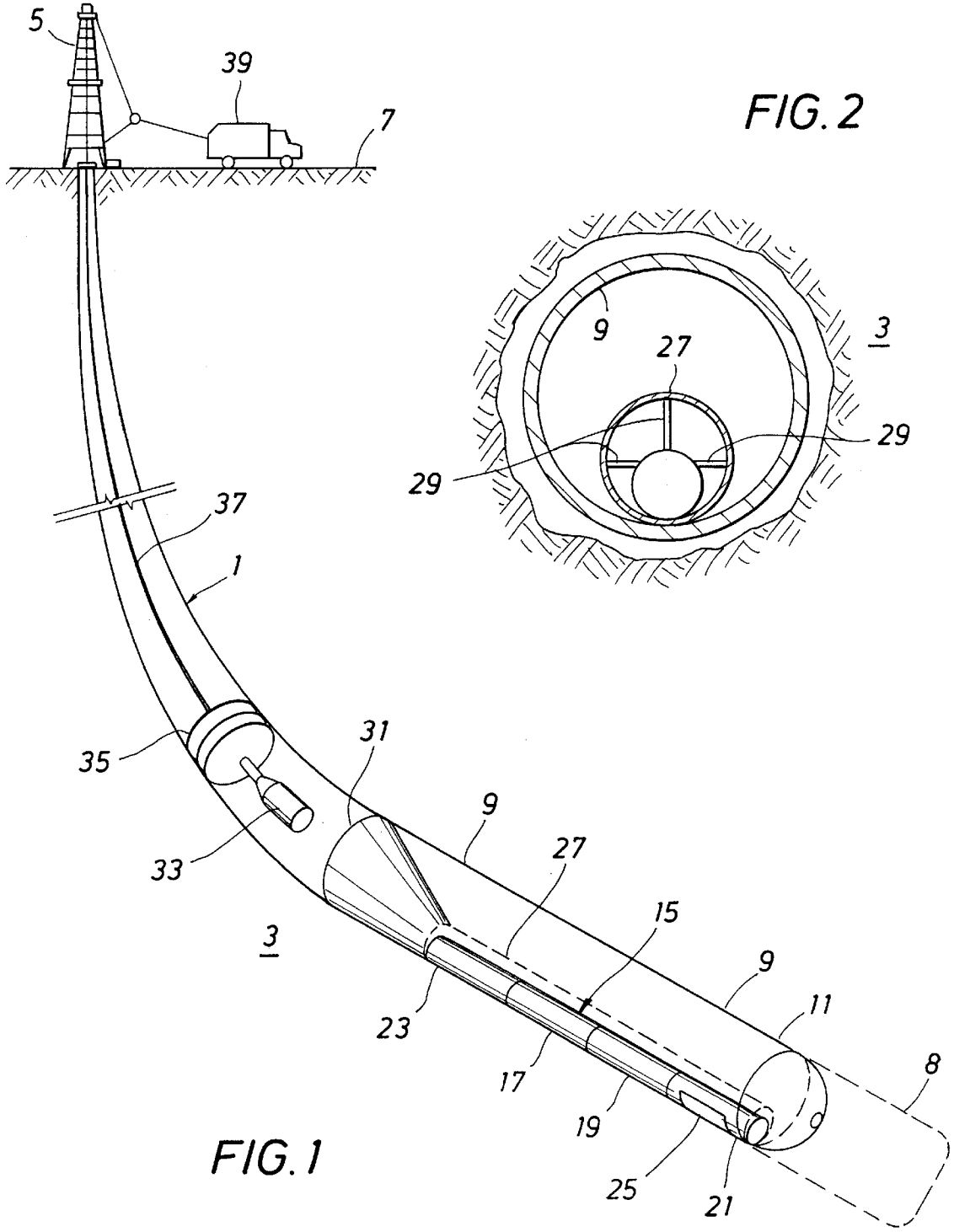
FIG. 1 schematically shows a system for carrying out the method according to the invention.
FIG. 2 shows a cross-section of a wellbore in which the method according to the invention is applied, wherein a logging tool is placed eccentrically in a casing shoe track.

Referring to FIGS. 1 and 2 there is shown a wellbore 1 which is being created by drilling into an earth formation 3 from a drilling rig 5 at the earth surface 7. An upper part of the wellbore I has been provided with tubular casing to prevent the wellbore from collapsing. As is common practice in wellbore drilling, the casing includes a plurality of casing sections of stepvtise decreasing diameter in downward direction. The wellbore 1 is further deepened by drilling a new, inclined, wellbore section 8 through previously installed casing sections (not shown), and lowering a casing section 9 of smaller diameter than the previously installed wellbore sections into the new wellbare section 8. In this manner casing sections of stepwise decreasing diameter are positioned in the wellbore.

The lower end part of the casing section 9, named the casing shoe track 11, is internally provided with a logging tool 15 composed of a gamma ray logging device 17, a neutron logging device 19, a density logging device 21, and a power/memory cartridge 23 which includes a suitable energy source for the tool. The casing section 9 is provided with a window 25 which can be in the form of an opening or an opening filled with fibre reinforced plastic material such as fibre reinforced epoxy, the window 25 being located opposite the density logging device 17. Some sections of the shoe track 11 can be made entirely of glass fibre reinforced epoxy, fibre reinforced cement or other suitable material, in order to optimize log response of tools affected by steel (e.g. Resistivity/Induction and Nuclear Magnetic Resonance type tools). In all cases the shoe track 11 will be designed to allow through-pumping of mud to the shoe track nose to allow full drilling functionality while lowering the casing. The materials used are selected so as to be able to be drilled out in case further deepening of the well is required. The logging tool 15 is retrievable located within an open ended retaining tube 27 made of glass fibre reinforced epoxy by means of arms 29, which retaining tube 27 is fixedly attached to the lower side of the inner surface of the casing section 9. The lower side of the casing is defined as the side that is pushed against the formation, either by casing centralizers (in vertical sections) or by the tools ex-centered weight, using a casing swivel (for example in horizontal sections).

A guide funnel 31 is located at the upper end of the retaining tube 27, which guide funnel 31 has a large diameter end remote from the retaining tube 27 and a small diameter end adjacent the retaining tube 27. The large diameter end corresponds to the inner diameter-r of the casing section 9 and the small diameter end corresponds to the inner diameter of the retaining tube 27.

During lowering of the casing section 9 in memory mode into the new wellbore section 8, the logging devices 17, 19, 21 of the logging tool 15 are operated and the logging data representing information on the earth formation surrounding the new wellbore section 8 are stored in the power/memory cartridge 23 (i.e. the tool is operated in memory mode). Because the logging tool 15 is located inside the casing shoe track 11, the latter protects the logging tool 15 from mechanical damage due to collision with the wellbore wall. Furthermore, by the arrangement of the logging tool 15 in the casing section 9 it is ensured that lowering of the logging tool 15 is not hampered by the irregularly shaped wellbore wall. Especially in case of horizontal or nearly horizontal wellbore sections which are to be logged, the method of the invention is of particular advantage since moving a logging tool through such newly drilled sections would be difficult, if not impossible, if the logging tool would be lowered by wireline or conveyed by drill pipe.

After the casing section 9 has been installed and prior to cementing, the casing section in the wellbore, a latching device 33 provided with suitable discs 35 (so-called swab cups) for pumping the latching device 33 through the wellbore 1 is inserted into the wellbore 1. The latching device 33 is connectable to the logging tool 15 and is connected to a wireline 37 or a coiled tubing (not shown) extending from surface into the wellbore 1. The wireline 37 or coiled tubing is provided with electric conducting means for transferring electric signals representing the logging data to surface, the conducting means at surface being connected to suitable data reading equipment at a logging truck 39. The latching device 33 is pumped through the wellbore 1 in downward direction. Upon arrival of the latching device 33 at the retaining tube 27, the guide funnel 31 guides the latching device 33 to the open upper end of the retaining tube until the latching device becomes corrected to the logging tool 15.

In a next step the logging data stored in the power/memory cartridge 23 are transferred to the data reading equipment via the electric conductor. Subsequently the logging tool is retrieved to surface 7 using the wireline 37 or the coiled tubing. Alternatively the logging data could be read from the logging tool 15 after the logging tool 15 has been retrieved to surface 7 or during retrieval of the tool to surface. Such wireline or coiled tubing can also be used to check the depth of the logging tool. The optimum method for depth control would be to leave the tool on during retrieval while measuring cable (or coiled tubing) depth at surface thus creating an optimal depth match curve.

The casing is then cemented, including the retaining tube 27 which can be drilled out of the casing section 9 using a conventional drill string if the wellbore is to be further deepened.

In case of temporary latching of the latching device to the logging tool, for example to perform logging while allowing full interactive data acquisition, the mechanical connection between the latching device and the logging tool is suitably selected to dis-latch at a force which is less than the force required to retrieve the logging tool to surface.

Instead of the logging tool being arranged entirely eccentrically in the casing shoe track, the tool can be positioned partly eccentrically and partly centralized, depending, on the type of tool and tool sensor or pad geometry applied.

In the above described procedure the logging data are stored in the power/memory cartridge and transferred to surface thereafter. However in an alternative mode of operation the logging data can be transferred to surface in a real-time mode using full interactive connection with a logging unit, for example during formation pressure testing at selected depths.

To establish a real time check that the logging tool is functioning properly while in memory mode, without the tool being connected to surface by a wireline, an internal check system providing intermittent pulses (pressure or electromagnetic) can be included in the tool string. The intermittent pulses can also be used to obtain real time data while running the wellbore component into the wellbore.

In the event of a tool failure, the tool can be retrieved by a pump down latch on a cable and be replaced by a back-up tool, whereafter logging operations can be resumed. If the logging tool is to be placed in the shoe track of an open liner (e.g. a slotted liner, a pre-drilled liner or a wirewrapped screen) a wash pipe can be positioned in the open liner to close off the openings in the liner so as to allow the latching device to be pumped through the open liner. Alternatively the tool can be connected to the wash pipe and retrieved together with the wash pipe.

I claim:

1. A method of operating a logging tool in a well-bred, the well-bore formed in an earth formation, which wellbore is to be provided with a wellbore component, wherein the wellbore component is selected from the group consisting of a wellbore casing, a wellbore liner, a slotted wellbore liner, an expandable slotted liner, a pre-perforated liner, a wellbore screen, a wire-wrapped screen, and a gravel pack screen, the method comprising:

arranging the logging tool in a selected relationship relative to the component so that the logging tool is guided by the component through the wellbore during lowering of the component into the wellbore;

lowering the component with the logging tool in the selected relationship, through the wellbore;

operating the logging tool so as to provide logging data of the earth formation surrounding the wellbore while the component is being lowered into the wellbore; and transferring the logging data to surface.

2. The method of claim 1 further comprising the step of connecting the logging tool to the component in the selected relationship.

3. The method of claim 1 wherein the logging tool is operated when the logging tool is located is the section of the wellbore.

4. The method of claim 1 wherein the logging tool is attached to the inner surface of the component at a selected side thereof, corresponding to a selected side of the earth formation to be logged.

5. The method of claim 4, wherein the logging tool is arranged within a retaining device attached to the inner surface of the component.

6. The method of claim 5 wherein the retaining device forms a tube made of a fibre-reinforced material.

7. The method of claim 6 wherein the fibre-reinforced material is selected from glass fibre-reinforced epoxy and fibre-reinforced cement.

8. The method of claim 1 wherein the logging tool includes at least one of a gamma ray logging device, a density logging device, a neutron logging device, an NMR logging device, a resistivity logging device, a micro resistivity/calliper logging device, and a sonic logging device.

9. The method of claim 8 wherein the logging tool includes a plurality of the logging devices arranged in a stacked manner.

10. The method of claim 8 wherein the component is provided with a window opposite a selected one of the logging devices.

11. The method of claim 10 wherein the window is filled with a material selected from fibre reinforced plastic, glass fibre reinforced epoxy and fibre reinforced cement.

12. The method of claim 11 wherein the logging device forms a pad type device extending though the window so as to contact the wellbore wall.

13. The method of claim 10 wherein the logging data are stored in the logging tool and are transferred to surface by lowering a pump-down latching device into the wellbore, the latching device being connectable to the logging tool and being provided with logging data retrieving means, pumping the latching device through the wellbore until the latching device is connected to the logging tool, and transferring the logging data via the logging data retrieving means to surface.

14. The method of claim 13 wherein the component is provided with a guide funnel so as to guide the latching device to the logging tool during connecting the latching device to the logging tool.

15. The method of claim 14 wherein the latching device is provided with logging tool retrieving means, and wherein the logging tool is retrieved to surface using the loggi rig tool retrieving means after measuring the parameter.

16. The method of claim 1 wherein the wellbore component forms a wellbore casing having a casing shoe track, and wherein the logging tool is at least partly arranged in the casing shoe track.

17. A system for operating a logging tool in a wellbore formed in an earth formation, which wellbore is to be provided with a wellbore component selected from the group consisting of a which wellbore is a liner, a slotted wellbore liner, an expandable lotted liner, a pre-perforated liner, a wellbore screen, a wire-wrapped screen, and a gravel pack screen, the system comprising:

means for connecting the logging tool to the wellbore component;

means for lowering the wellbore component with the logging tool connected thereto into the wellbore;

means for operating the logging tool while the component is being lowered into the wellbore, so as to provide logging data of the earth formation surrounding the wellbore; and means for transferring the logging data to surface.

* * * * *